US006315876B1

(12) United States Patent
Delahoyde et al.

(10) Patent No.: US 6,315,876 B1
(45) **Date of Patent: *Nov. 13, 2001**

(54) CATHODIC PROTECTION SYSTEM

(75) Inventors: James E. Delahoyde, Medina, OH (US); William P. Carlson, Hoffman Estates, IL (US)

(73) Assignee: CorrPro Companies, Inc., Medina, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/233,461

(22) Filed: Apr. 26, 1994

(51) Int. Cl.[7] ..... C23F 13/00; G01N 27/30

(52) U.S. Cl. ..... 204/196.06; 204/196.01; 204/196.33; 204/196.36; 204/435; 205/724; 205/727

(58) Field of Search ..... 204/147, 148, 204/196, 197, 435, 196.06, 196.36

(56) References Cited

U.S. PATENT DOCUMENTS

Re. 25,565 * 4/1964 Sabins .
2,851,414 * 9/1958 Hubbard .
2,943,027 * 6/1960 Schaschl et al. .
3,108,939 * 10/1963 Sabins .
3,830,719 * 8/1974 Cavil .
4,056,446 * 11/1977 Vennett .
4,080,565 * 3/1978 Polak et al. .
4,251,343 * 2/1981 Peterson et al. .
4,255,241 * 3/1981 Kroon et al. .
4,489,277 * 12/1984 Goolsby .
4,664,764 * 5/1987 Zofan .
4,685,465 * 8/1987 Kitgaard et al. .
5,012,868 * 5/1991 Bridges .

* cited by examiner

*Primary Examiner*—T. Tung
(74) *Attorney, Agent, or Firm*—Renner, Otto, Boisselle & Sklar, LLP

(57) ABSTRACT

A preassembled cathodic protection system is provided for protecting buried structures such as guy anchors, which includes a reference cell, test station and anode, all prewired together and tested before delivery and field installation. The package includes a convenient connection for the structure which has one lead to an exposed stud or contact point on the test station, and another lead from the connection to the anode or anodes through a shunt in the form of a calibrated resistance wire. The shunt is connected to two spaced studs or contact points on the test station by which the shunt is read. The reference cell is also connected to a stud or contact point on the test station. The reference cell-test station lead extends through a flexible tube. The studs or contact points are on the dome or cap of a rigid tube designed to project out of the ground or an electrolyte a short distance. With a guy anchor the tube may include an elow and angled portion. The interior of the dome or cap is totally encapsulated in epoxy or other potting or sealing compound, which encapsulation includes all of the test station connections as well as the shunt.

10 Claims, 3 Drawing Sheets

CATHODIC PROTECTION SYSTEM

This invention relates generally as indicated to a cathodic protection system for buried structures such as guy anchors, and more particularly to a reference cell-test station-anode combination prepackaged, assembled and tested for installation as a unit.

BACKGROUND OF THE INVENTION

In the prior copending application of Bushman et al., entitled Reference Cell, Ser. No. 07/874,745, filed Apr. 27, 1992, now U.S. Pat. No. 6,187,161 B1, there is disclosed a reference cell-test station combination which is prepackaged assembled and tested for installation as a unit. However, the combination doesn't include an anode or anode system.

The system shown in such prior application is used to monitor the levels of cathodic protection of underground tanks and piping. The system is self contained and includes a permanent copper sulfate reference cell packaged in a special backfill that contains a ceramic cell as described in the copending application of Carlson, Ser. No. 07/739,193, filed Aug. 1, 1991, entitled "Electrode". The prior systems are available as a two or four wire unit capable of monitoring two or four structures, respectively. However, the prior system cannot monitor the current output of the cathodic protective system, nor is such system part and parcel of the prior combination package.

It would, therefore, be desirable for the cathodic protection system to be part and parcel of a combination package which can be assembled, tested and packaged for ease of installation rather than be fabricated, installed and tested in the field. It would also be desirable for the packaged system to be able to monitor the current output of the cathodic protection system. In this manner, the structure or system could be monitored to evaluate the level of cathodic protection, and also evaluate the anticipated life of the system.

SUMMARY OF THE INVENTION

A preassembled cathodic protection system is provided for protecting buried structures such as guy anchors, which includes a reference cell, test station and at least one anode, all prewired together and tested before delivery and field installation. The package includes a convenient connection for the structure which has one lead to an exposed stud or contact point on the test station. Another lead extends from the connection to the anode or anodes through a shunt in the form of a calibrated resistance wire. The shunt is connected to two spaced studs or contact points on the test station by which the shunt is read. The reference cell is also connected to a stud or contact point on the test station. The reference cell-test station lead extends through a flexible tube. The studs or contact points are on the dome or cap of a rigid tube designed to project out of the ground or an electrolyte a short distance. With a guy anchor the tube may include an elbow and angled portion. The interior of the dome or cap at the top of the test station is totally encapsulated in epoxy or other potting or sealing compound. This includes all of the test station connections as well as the shunt.

With the present invention, the system can monitor both potentials as well as current output of the cathodic protection system. The entire package is assembled tested, and evaluated under controlled conditions following strict quality control programs and procedures.

The system is particularly useful for protecting guy anchors. The test station may be tied directly to the guy to project from the earth or electrolyte at the same angle as the guy anchor, or it may include the mentioned elbow and project vertically.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

FIG. 3 is a schematic installation of a two anode system showing the excavation partly filled in;

DETAILED DESCRIPTION OF THE PREFERRED EMBODIMENTS

Figure 1:
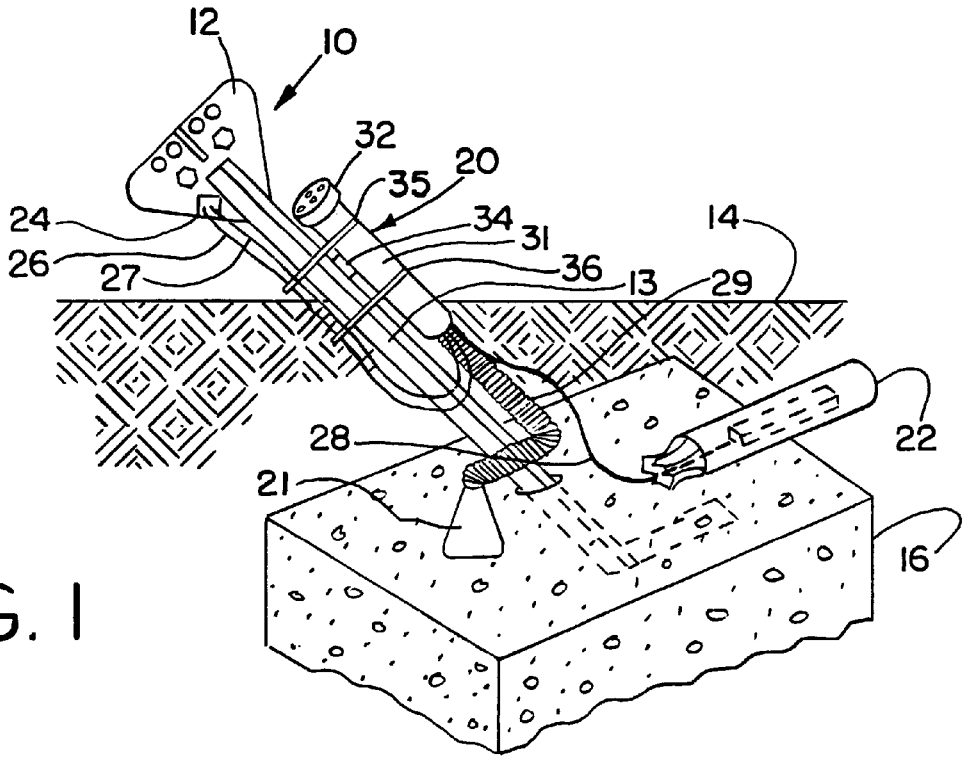
FIG. 1 is a schematic illustration of one form of system in accordance with the present invention installed and using a single anode.

Referring initially to FIG. 1 there is illustrated a buried structure which comprises a guy anchor shown generally at 10, the upper end of which includes triangular plate 12, to which guy wires or cables are normally attached. The shaft or shank 13 of the guy anchor extends downwardly through the soil or electrolyte 14 and is anchored in a buried steel reinforced concrete block 16. Typically there may be three or many more guy anchors surrounding a tower and such guy anchors may vary significantly in size depending upon the type and size of tower or mast being stayed.

The cathodic protection system for the guy anchor illustrated comprises a test-station shown generally at 20, a reference cell illustrated at 21, and an anode illustrated at 22. The cathodic protection system also includes a connector indicated at 24, by which the required leads to the structure may readily be electrically connected. As hereinafter more clearly described, both leads from the structure shown at 26 and 27 lead into the test station 20 as does the lead 28 from the anode. The lead from the reference cell 21 to the test station extends through flexible tube 29. The flexible tube 29 protects the lead from the reference cell to the test station. The details of the flexible tube and the reference cell may be seen more clearly in the aforenoted copending applications of Bushman et. al. and Carlson, respectively.

In the embodiment seen in FIG. 1, the test station comprises a rigid linear tube such as a PVC tube indicated at 31 which has a dome or cap 32 on the top thereof. The cap 32 has situated therein the studs or contact points of the test station from which measurements are taken. The flexible tube 29 projects from the lower end of the rigid tube 31. The test station is mounted on the guy anchor by simply positioning a spacer indicated at 34 between the tube and the guy anchor shaft and then securing the same in place with plastic ties indicated at 35 and 36. The ties may also secure the insulated leads 26 and 27 parallel to the guy anchor shaft.

The reference cell 21 is preferably placed at least about 6 inches away from the underside of the guy anchor shaft and at approximately the same level as the anode 22. In the embodiment of FIG. 1, both may be placed approximately at the same level as the top of the concrete block 16.

Figure 2:
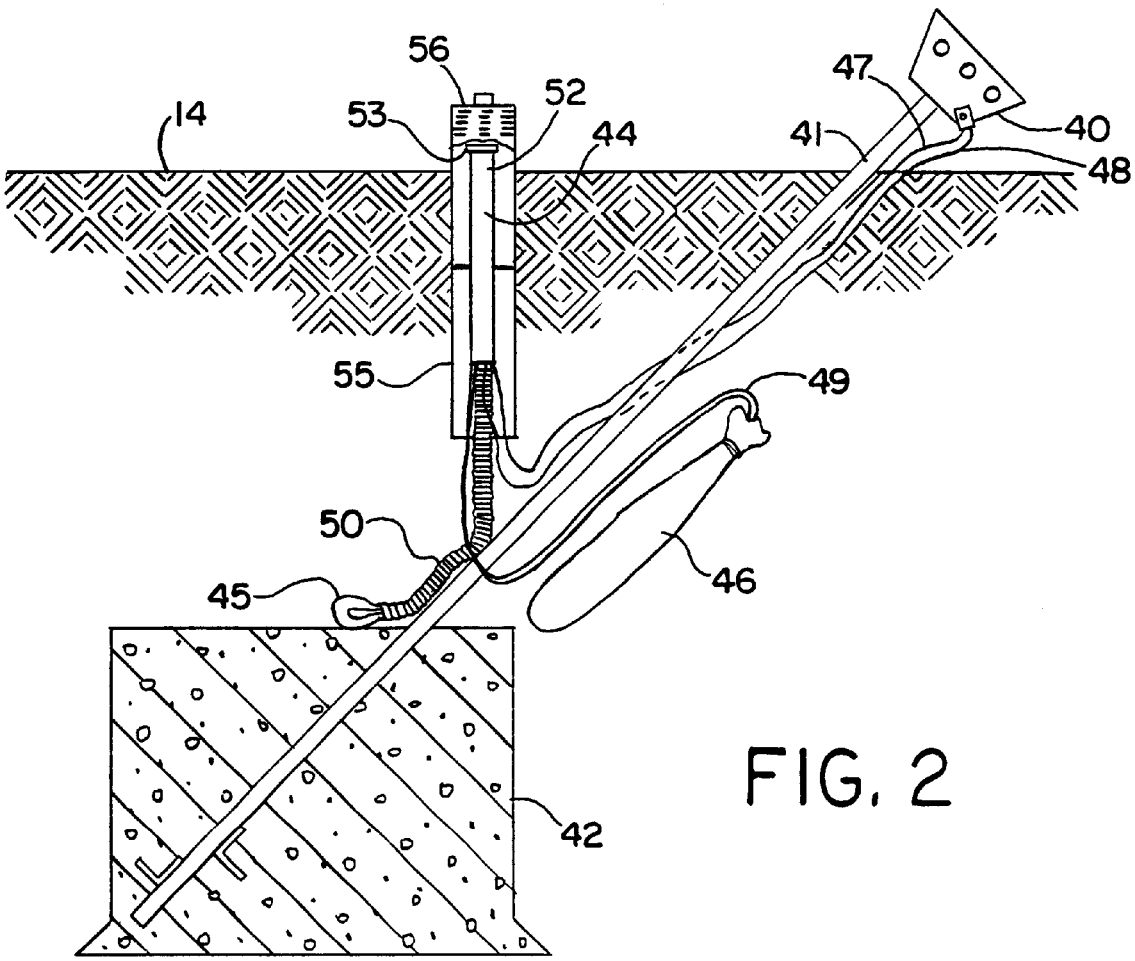
FIG. 2 is a similar schematic using a similar system but with the test station inside a well casing.

Referring now to FIG. 2, there is illustrated a slightly different type of guy anchor which includes an anchor head 40, and inclined shaft 41, and a reinforced concrete block 42, in which the lower end of the shaft is embedded. Again, the majority of the shaft of the guy anchor as well as the reinforced concrete block are below the level 14 of the earth or electrolyte.

The cathodic protection system includes the test station 44, reference cell 45 and anode 46. Two leads indicated at 47 and 48 are connected to the anchor head and extend to the test station 44. A single lead 49 connects the anode to the test station while the reference cell 45 is connected to the test station by a lead extending through flexible tube 50. The test station includes the rigid plastic tube 52 at its upper end which terminates in the cap or dome 53. The test station is mounted inside a well casing 55. The well casing is preferably a relatively large length of PVC pipe which has a screw-in cap 56. Thus in order to take electrical measurements from the test station, the cap 56 must be removed.

Again, the reference cell 45 is situated on top of the block while the anode 46 is placed above the concrete block and preferably no more than about 12 inches from the anchor shaft.

Figure 4:
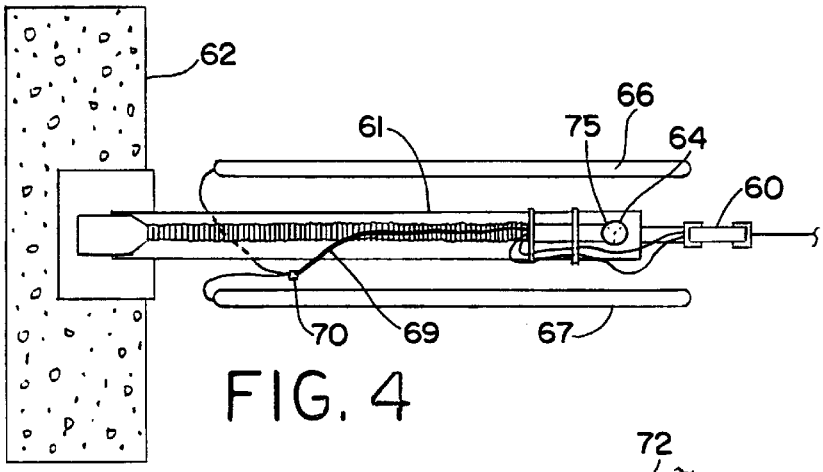
FIG. 4 is a top plan view of the system of FIG. 3 with the soil or electrolyte not shown.
Figure 3:
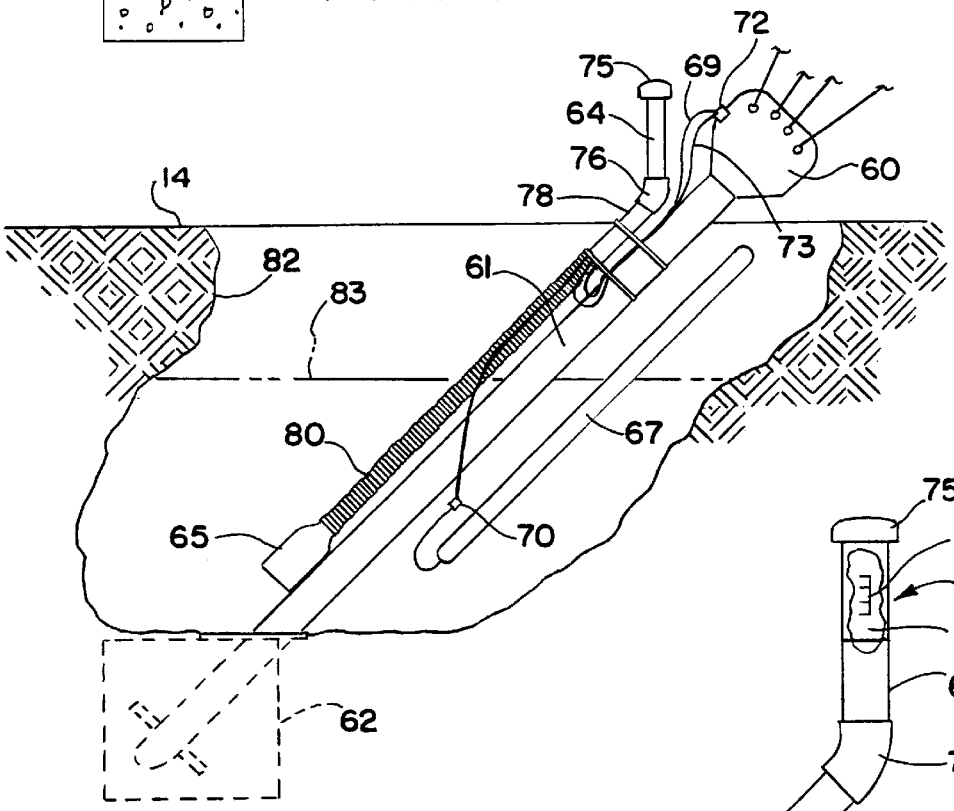

Referring now to FIGS. 3 and 4, there is illustrated a guy anchor head seen at 60, the shaft 61 of which extends at an angle downwardly to reinforced concrete block 62. Most of the shaft and all of concrete block are submerged below the soil line indicated at 14.

In this illustrated embodiment, the cathodic protection system includes a test station 64, a reference cell 65, and two anodes illustrated at 66 and 67. As illustrated, the anodes may be quite long and are positioned at an angle generally parallel to and equally spaced on each side of the shaft 61. The anodes 66 and 67 are electrically connected to single lead 69 through the connection illustrated at 70. The lead 69 extends to the test station 64 and from the test station 64 to the connection 72 on the anchor head 60. The other lead 73 from the connection 72 extends to the test station.

The test station is provided with the dome cap indicated at 75 and below the short vertical upper section is provided with an elbow 76. The test station includes a short section of inclined rigid pipe seen at 78 which is mounted on the shaft 61 by the spacer and ties illustrated in the same manner as in FIG. 1. The reference cell 65 is connected to the test station 64 by a lead extending through the flexible conduit illustrated at 80.

With reference to FIG. 3, it will be appreciated that the anode system may be installed by forming an excavation such as shown at 82 and then installing the components, their final position being obtained as the excavation is backfilled as indicated schematically by the dotted line 83. The placement of the backfill and its compaction has to be performed carefully so as not to damage wires or other test devices, and to assure the reference cell and anode or anodes are in the proper selected position.

Figure 5:
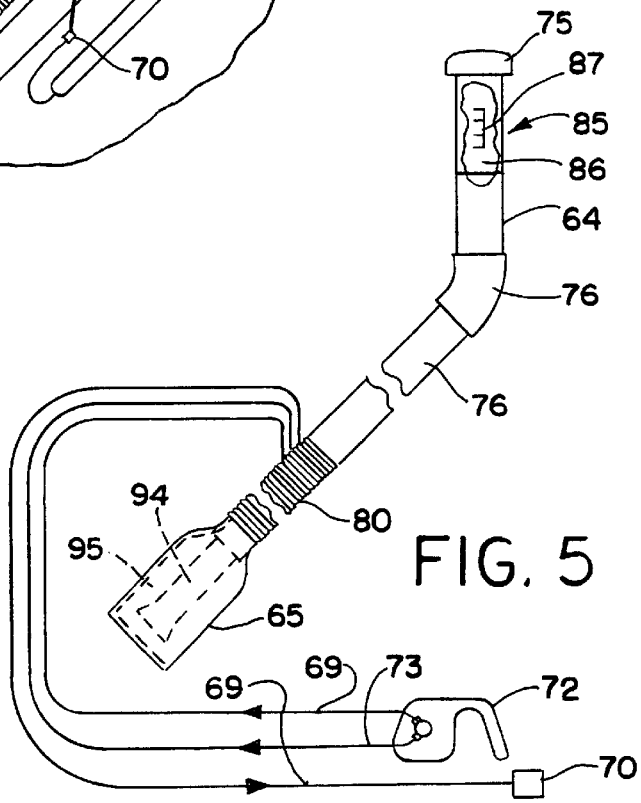
FIG. 5 is a schematic wiring diagram of the system with the flexible and rigid conduit or tube broken away, the later to show the location of the shunt in the encapsulation inside the tube.

With reference to FIG. 5, it will be noted that the upper end of the test station is broken away as seen at 85 and the purpose is to illustrate encapsulation 86 which encapsulates shunt 87 as well as all internal connections to the studs or contact points 90, 91, 92 and 93 on top of the cap 75. Also as seen in FIG. 5, the reference cell 65 comprises a ceramic canister illustrated at 94 surrounded by a geotextile container of hygroscopic material indicated at 95. As indicated, the cell is more clearly shown and described in the prior to copending applications mentioned above.

Figure 7:
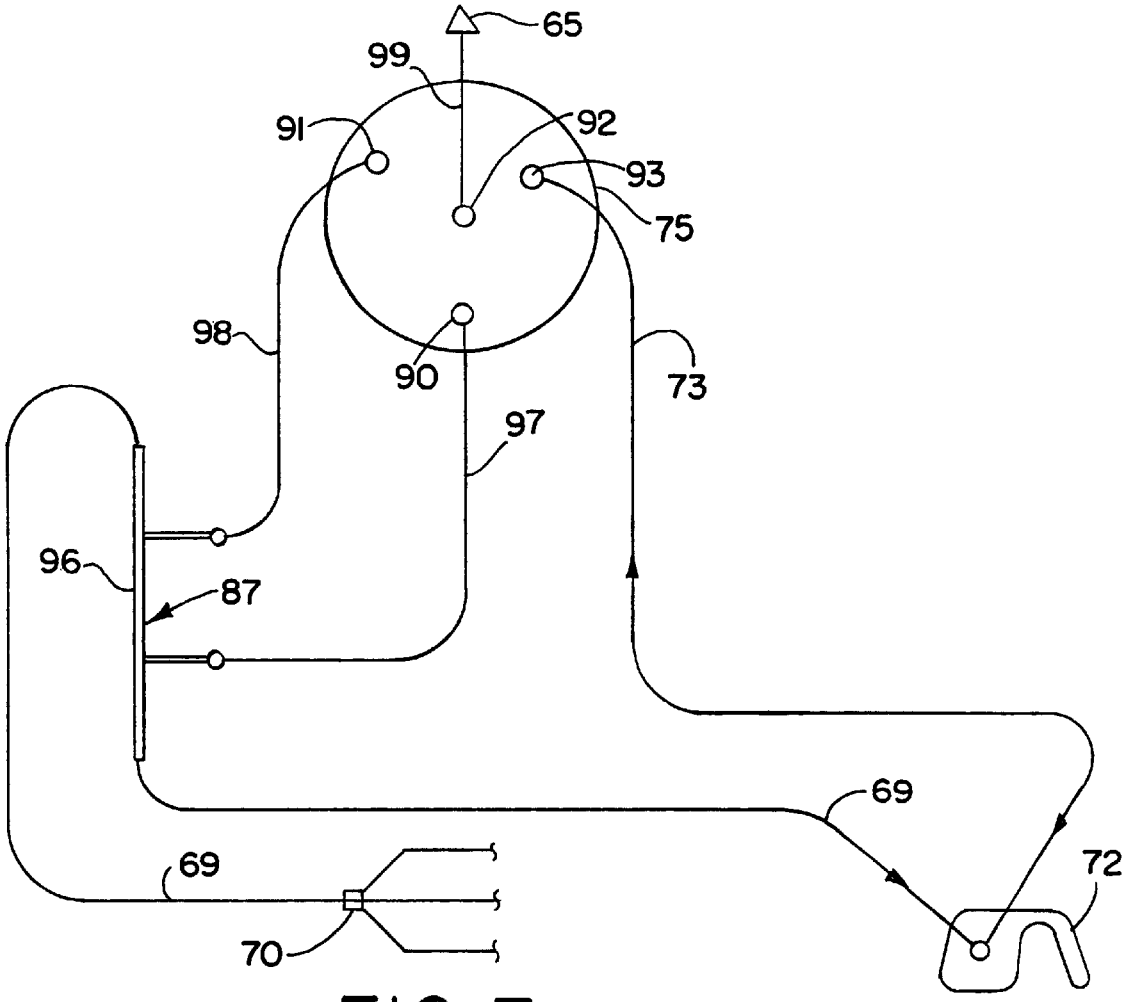
FIG. 7 is a schematic wiring diagram of the system.

Referring now to FIG. 7, there is illustrated a wiring diagram of the cathodic protection system without the confines of the shunt being within the encapsulated upper portion of the test station. As illustrated, the shunt 87 is in the form of a calibrated resistance wire 96 which is connected by leads 97 and 98 to the studs or contact points 90 and 91, respectively on the cap 75. The shunt forms part of the lead 69 which extends from the anode connection 70 to the connector 72 which is attached to the structure. FIG. 7 illustrates leads for at least 3 anodes connected at 70. In any event, the anodes as a group will be connected to the structure through the shunt which is then read from the contact points 90 and 91 on the test station. The test station cap 75 also includes contact points 92 and 93 to which the wires 73 and 99 are connected, the later leading to the reference cell 65. The lead 73 connects the connector 72 and the contact point 93.

Figure 6:
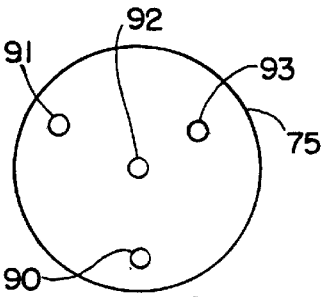
FIG. 6 is a top plan view of the dome or monitor showing the location of the exposed studs or contact points.

It is noted from FIGS. 6 and 7 that the contact points on the cap are spaced so that a probe set a fixed distance apart can measure the current either between studs 90 and 91, or the potential between studs 92 and 93, but cannot confuse the two. Although it is possible to take the two readings with two separate instruments, again having probe spacings corresponding to the proper contact points, it is preferred that the test readings be done by a single meter capable of obtaining both the shunt reading and the potential reading.

Figure 8:
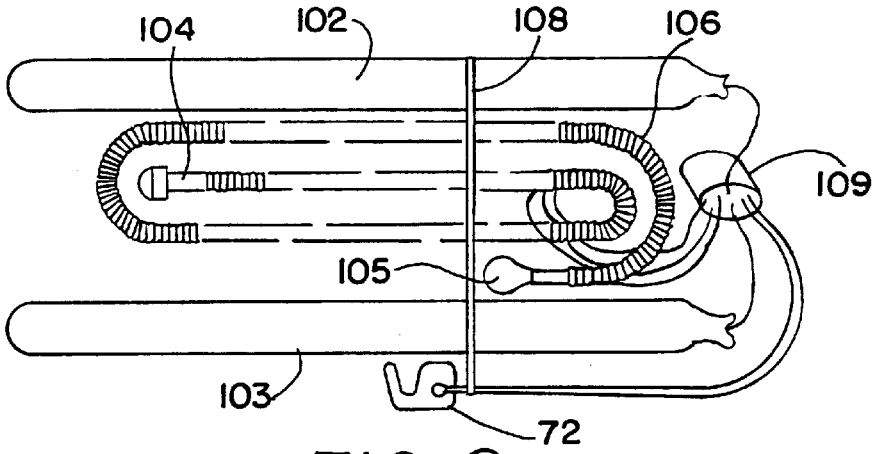
FIG. 8 is an illustration of the system packaged for shipment and installation.

Referring now to FIG. 8, there is illustrated a package unit of the system which has been assembled and tested at the plant or laboratory. The anodes are shown at 102 and 103. The test station is shown at 104 while the reference cell is shown at 105. The flexible tube connecting the reference cell and test station may be coiled between the anodes as illustrated and the entire assembly held together by a plastic strap or tie indicated at 108, such tie also capturing the connection 72 and the two leads therefrom. Any excess wiring may be coiled in cylindrical container or package 109. In the field, the unit is open simply by cutting the strap or tie 108 and removing the coiled up wire from the container 109. The system may employ extra strength cabling with TEFLON insulation that is ultraviolet stabilized and oil and gas resistant. It will be appreciated that the systems may be ordered with varying lengths of cabling and also varying lengths between the test station and reference cell.

It can now be seen that with the present system all of the quality control of plant or laboratory assembly can be built in to the cathodic protection system which can then quickly and easily be installed without the necessary field fabrication. Once the system is installed, it can monitor potentials as well as the monitor the current output of the cathodic protection system. In this manner, the system will enable the evaluation not only of the level of cathodic protection, but also the life of the system.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What we claim is:

1. A packaged cathodic protection system for the protection of a guy anchor structure and the like comprising a test station, reference cell, and at least one anode, said system including a connection adapted to be electrically secured to said structure, a first electrical lead from the connection to the test station, and a second electrical lead from the connection to said anode, said second electrical lead including a shunt comprising a calibrated resistance wire which is encapsulated in said test station, and a third electrical lead from the reference cell to the test station, said test station including a pair of studs exposed at a top of a tube for reading a cell-to-structure potential and a pair of studs exposed at the top of said tube for reading an anode-to-structure current, wherein the connections to said studs are encapsulated at the top of said tube, and spacing of the studs to read the cell-to-structure potential is different than spacing of the studs to read the anode-to-structure current, whereby a probe with fixedly spaced electrodes can contact one pair of said studs but not the other pair of said studs.

2. A system for cathodically protecting buried structures comprising a test station, a reference cell electrically connected to the test station, and at least one anode electrically connected to the test station, said system being wired and tested for operationality prior to installation, wherein said system includes an electrical connection for the structure, means at said test station to measure the potential between said reference cell and structure, and means including a shunt at said test station to measure current flow between said anode and structure, said shunt and all electrical connections to the test station being internal of the test station and sealed and encapsulated therein, and wherein both said means at said test station comprise a pair of contact studs on said test station, the studs of each pair being spaced differently.

3. A system as set forth in claim 2 wherein said shunt comprises a calibrated resistance wire.

4. A prepackaged and tested cathodic protection system for metal structures comprising an anode adapted to be positioned in an electrolyte near the structure, a reference cell also adapted to be positioned in such electrolyte spaced from the cell and structure, a test station for the system comprising respective electrical contact points for said cell and structure forming a first pair of contact points, respective electrical connections between said cell and structure and the respective contact points of said first pair, and a third electrical connection between said anode and structure, said third connection including a shunt, said connections to said contact points and said shunt being encapsulated and sealed within said test station, and means operative to read said shunt to said test station, wherein said last mentioned means comprises a second pair of contact points on said test station, the spacing between said first pair of contact points being different from the spacing between said second pair of contact points, whereby a probe having fixed contacts corresponding to the spacing of one of said pair of contact points can read only that pair of contact points.

5. A system as set forth in claim 4 wherein said test station includes a domed top exposed above the electrolyte supported on top of a rigid pipe, said contact points being on top of said dome while the interior of the dome is encapsulated.

6. A system as set forth in claim 5 wherein said connections and shunt are encapsulated directly beneath the dome at the top of the test station.

7. A system as set forth in claim 5 including an elbow in said pipe whereby the upper end of the pipe extends substantially plumb while the lower end extends at an angle.

8. A system as set forth in claim 7 wherein said structure is an angularly extending guy, and means to secure the lower end of the pipe to the guy.

9. A system as set forth in claim 8 wherein said reference cell comprises a ceramic canister at the lower end of a flexible tube connected to the lower end of the pipe.

10. A system as set forth in claim 9 including at least two anodes positioned generally parallel to and yet spaced from the guy.

* * * * *